US008393875B2

(12) United States Patent
Prescott

(10) Patent No.: US 8,393,875 B2
(45) Date of Patent: Mar. 12, 2013

(54) PRESSURE-CONTROLLED LIQUID SUPPLY SYSTEM AND PUMP CONTROL DEVICE FOR USE THEREIN

(75) Inventor: Russell E. Prescott, Exeter, NH (US)

(73) Assignee: R. E. Prescott Co., Inc., Exeter, NH (US)

( * ) Notice: Subject to any disclaimer, the term of this patent is extended or adjusted under 35 U.S.C. 154(b) by 385 days.

(21) Appl. No.: 12/860,356

(22) Filed: Aug. 20, 2010

(65) Prior Publication Data

US 2011/0042282 A1 Feb. 24, 2011

Related U.S. Application Data

(60) Provisional application No. 61/235,508, filed on Aug. 20, 2009.

(51) Int. Cl.
*F04B 49/02* (2006.01)
*E03B 11/16* (2006.01)

(52) U.S. Cl. ..... 417/44.2; 137/599.11; 137/565.01

(58) Field of Classification Search ..... 417/44.2, 417/44.3, 44.4, 53, 38; 137/599.11, 599.13, 137/601.18, 601.2, 565.01, 535; 200/81.9 R; 210/117
See application file for complete search history.

(56) References Cited

U.S. PATENT DOCUMENTS 1,744,872 A * 1/1930 Earl ..... 137/9
2,408,851 A * 10/1946 Hillier et al. ..... 417/43
2,719,889 A * 10/1955 Miller ..... 200/81.9 R
2,944,488 A * 7/1960 Meyer ..... 417/25
3,226,505 A * 12/1965 Lucas et al. ..... 200/81.9 R
3,510,616 A * 5/1970 Breunich et al. ..... 200/81.9 R
4,182,125 A * 1/1980 Spivey, Jr. ..... 60/431
5,081,328 A * 1/1992 Friend et al. ..... 200/81.9 R
5,111,660 A * 5/1992 Gettel ..... 60/468
5,190,068 A * 3/1993 Philbin ..... 137/8
5,269,659 A * 12/1993 Hampton et al. ..... 417/12
5,281,101 A * 1/1994 Bevington ..... 417/38
5,703,552 A * 12/1997 Buffet et al. ..... 335/205
5,988,984 A 11/1999 Austin
6,073,653 A * 6/2000 Nishio et al. ..... 137/599.13
6,149,824 A * 11/2000 Chace et al. ..... 210/779
6,372,024 B1 4/2002 Prescott
7,445,025 B2 * 11/2008 Shafique et al. ..... 137/614.2
8,197,221 B2 * 6/2012 Lemmer et al. ..... 417/44.2
2009/0301577 A1 * 12/2009 Carter et al. ..... 137/484.2

* cited by examiner

*Primary Examiner* — Devon Kramer
*Assistant Examiner* — Nathan Zollinger
(74) *Attorney, Agent, or Firm* — Grossman Tucker Perreault & Pfleger, PLLC

(57) ABSTRACT

A pressure-controlled liquid supply system uses a pump control device to switch a pump on and off in response to a pressure level in the pumped liquid. The pump control device minimizes short cycling of the pump by preventing shut off of the pump while a flow is present through the pump control device and by delaying the shut off of the pump. The pump control device also avoids a significant drop in the output pressure by creating a reduced pressure zone, which provides the switch pressure used to switch the pump off.

24 Claims, 4 Drawing Sheets

PRESSURE-CONTROLLED LIQUID SUPPLY SYSTEM AND PUMP CONTROL DEVICE FOR USE THEREIN

CROSS-REFERENCE TO RELATED APPLICATIONS

This application claims the benefit of U.S. Provisional Patent Application Ser. No. 61/235,508, filed on Aug. 20, 2009, which is incorporated herein by reference.

TECHNICAL FIELD

The present invention relates to pressure-controlled liquid supply systems and more particularly, to a pump control device for use in a pressure-controlled liquid supply system.

BACKGROUND INFORMATION

Liquid supply systems often include a pump that pumps liquid from a source to a destination system. In a residential water supply system, for example, a pump may be used to pump water from a source, such as a well or a water treatment system, to the home. In such systems, the water is often used irregularly in the home and a relatively small, pressurized cycle tank may be used to hold water before being supplied to the home. The pump generally operates in response to pressure to pump water to the home and/or cycle tank. For example, the pump may be switched on when the pressure drops to 50 PSI (i.e., when the cycle tank is drained) and may be switched off when the pressure rises to 70 PSI (i.e., when the cycle tank is filled). When the water is turned on in the home, for example, a sudden drop in pressure as the cycle tank drains causes the pump to be switched on and a sudden increase in pressure as the pump fills the cycle tank back up causes the pump to be switched off. With relatively small cycle tanks (e.g., 2.1 gallons), the pump will often be switched on and off multiple times during a single use due to the sudden pressure changes. The repeated switching may cause damage to the pump and the pump motor.

To provide constant pressure and avoid the "short cycling" of the pump when using relatively small cycle tanks, electronic automatic pump controls have been used. These controls generally include a pressure switch (e.g., set at 50 PSI on and 70 PSI off), a flow switch (e.g., set at 1 GPM), and a time delay (e.g., set at 8 seconds). When used with a 75 PSI maximum pressure pump, for example, the electronic pump control may be programmed to start the pump at 50 PSI and stop the pump 8 seconds after the pressure is over 70 PSI and the flow is less than 1 GPM. Electronic pump controls use pressure regulators where the pump pressure exceeds typical house pressures (e.g., 75 PSI). Due to their complexity, electronic pump controls are susceptible to leaks and electronic failures and may not be repairable or easily serviced. Other problems with electronic pump controls include an inconsistent turn-on pressure and low sensitive flow switch causing cycling even at higher flow rates (e.g., at shower flows of 2.5 GPM).

Mechanical pump controls are also available, such as the type disclosed in U.S. Pat. No. 5,988,984, which is incorporated herein by reference. These controls generally include a pressure switch, a pressure regulator, and 1 GPM bypass flow stream around the pressure regulator. When used with a 75 PSI maximum pressure pump, for example, the pressure regulator is generally set at 65 PSI and the pressure switch is set to start the pump at 50 PSI and stop the pump at 70 PSI once flow drops below 1 GPM, allowing the bypass flow stream to slowly build pressure to 70 PSI. One problem with this type of pump control is the loss of outlet pressure, which may be 10 PSI or more considering fall off pressure at higher flows. Such a loss of pressure is often undesirable, for example, in a residential system. Existing mechanical pump controls are also relatively expensive and also have many intricate parts resulting in a complexity that makes servicing such pump controls relatively difficult.

Short cycling may also be a problem in other liquid supply systems such as, for example, a residential fire sprinkler system. In such a system a pump may be used to pump water from a source, such as a water holding tank, to fire sprinkler heads. To avoid short cycling in these applications, a flow switch may be used to keep the pump running after a pressure switch starts the pump. Existing systems, however, often require extensive plumbing and wiring, are relatively complex, expensive and do not have a minimum run time delay.

Short cycling may also be a problem in various other liquid supply systems. In low flow residential whole house water treatment systems (e.g., reverse osmosis), for example, a pump may be used to pump water from a holding tank to a destination system in a home. In a low flow well water or city water supply for residential homes (e.g., with flows of 2.5 GPM or less), water may fill a holding tank and then may be pumped from the holding tank to the home. In a rainwater collection system, rainwater may fill a holding tank and then may be pumped from the holding tank to a destination system.

Other liquid supply systems in which short cycling may be a problem due to irregular water use include booster pump systems in which a pump may be used to boost town water pressure to one or more homes or commercial destinations and lawn or irrigation systems in which a pump may be used to pump from a source to drip irrigation and/or sprinkler heads.

BRIEF DESCRIPTION OF THE DRAWINGS

These and other features and advantages will be better understood by reading the following detailed description, taken together with the drawings wherein.

DETAILED DESCRIPTION

A pressure-controlled liquid supply system uses a pump control device to switch a pump on and off in response to a pressure level in the pumped liquid. The pump control device minimizes short cycling of the pump by preventing shut off of the pump while a flow is present through the pump control device and by delaying the shut off of the pump. The pump control device also avoids a significant drop in the output pressure by creating a reduced pressure zone, which provides the switch pressure used to switch the pump off.

Figure 1:
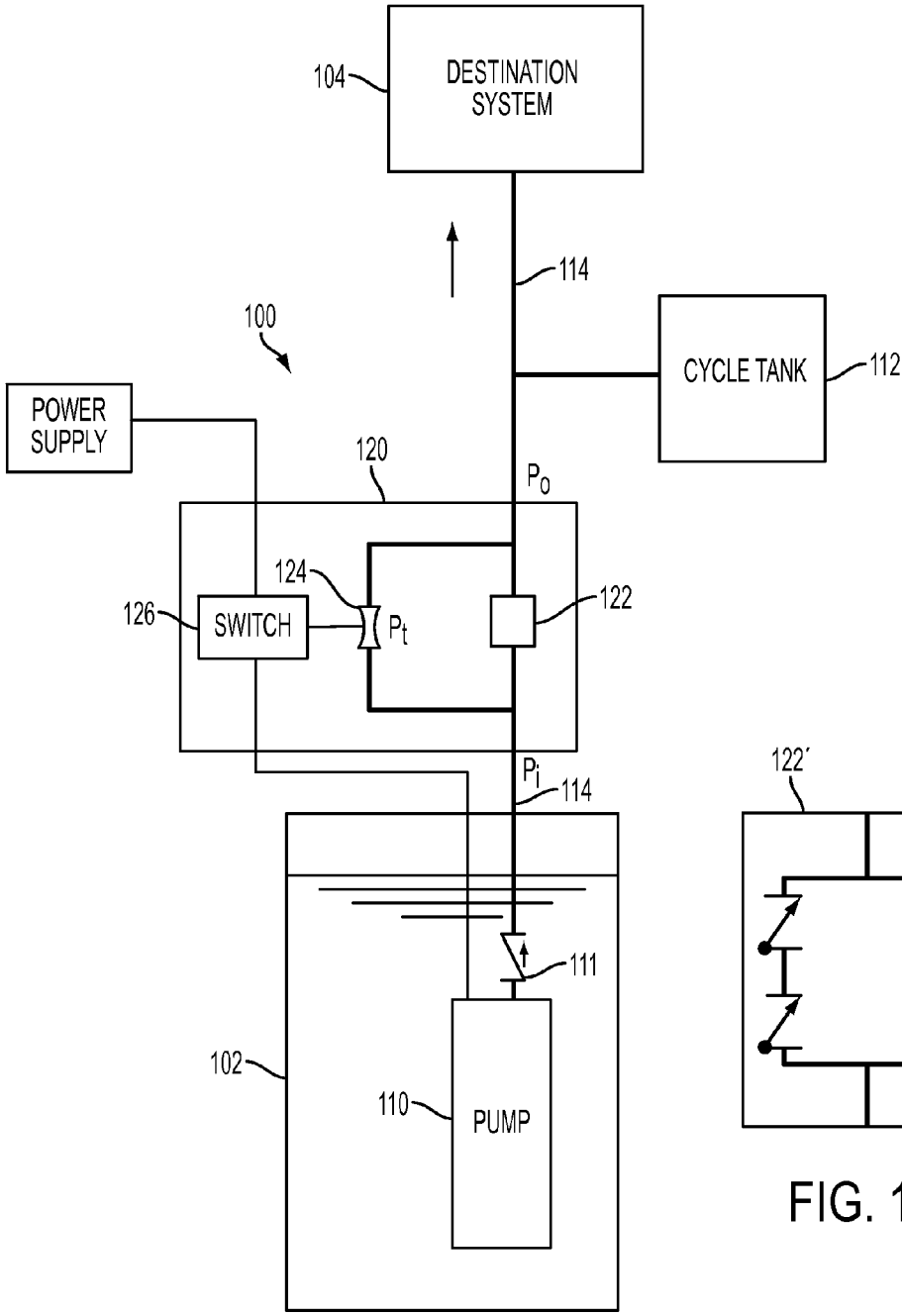
FIG. 1 is a schematic view of a pressure-controlled liquid supply system, consistent with embodiments of the present invention.

Referring to FIG. 1, one embodiment of a pressure-controlled liquid supply system 100 includes a pump 110 with a check valve 111 for pumping a liquid from a source 102 to a destination system 104 and a pump control device 120 for controlling the pump 110 in response to a pressure level in the pumped liquid. The pressure-controlled liquid supply system 100 also includes a cycle tank 112 for temporarily holding the liquid before it is supplied to the destination system 104. The pump 110, check valve 111, pump control device 120, cycle tank 112 and destination system 104 may be fluidly coupled via a conduit 114, such as a pipe. As used herein, "fluidly couple" or "fluid coupling" is not limited to a direct mechanical connection and may include an indirect mechanical connection that is made through other components or structures capable of allowing fluid to flow.

In general, the pump control device 120 causes the pump 110 to switch off when a switch pressure exceeds a first pressure level or shut off pressure and causes the pump 110 to switch on when the switch pressure falls below a second pressure level or turn on pressure. To delay the shut off and prevent short cycling of the pump 110 (e.g., at lower flows), the switch pressure is taken at a reduced pressure zone having a lower pressure than an outlet pressure at an outlet of the pump control device 120 when a flow is present. The pump control device 120 uses a venturi in parallel with a pressure opening device to create the desired reduced pressure zone, as will be described in greater detail below.

In an exemplary embodiment, a pressure-controlled liquid supply system 100 may be used to supply water from a water source, such as a city water supply, a well or a water treatment system, to a residential water system. Water treatment systems may include water softeners, acid neutralizers, iron/manganese removal systems, arsenic removal systems, reverse osmosis systems, and aeration systems used to filter and/or treat the water being supplied from a water source (e.g., from a well or city water supply). One example of an aeration system is the System and Method for Removing Contaminating Gases from Water disclosed in U.S. Pat. No. 6,372,024, which is incorporated herein by reference. The water treatment system directs water from a supply line through one or more water treatment devices and then to a delivery line that provides water to a distribution system in a building, such as a residential home. The water treatment systems may be coupled, for example, to a residential water supply system at the point of entry. In such a water treatment system, the source 102 may be a water treatment tank containing treated water and the pump 110 may be submerged in the tank.

The pressure-controlled liquid supply system 100 may also be used to supply other types of liquids in other applications where short cycling may be a problem. Such applications include, but are not limited to, a residential fire sprinkler system, a booster pump system, and an irrigation system. In a fire sprinkler system or an irrigation system, for example, the destination system 104 may include sprinkle heads or irrigation heads that distribute the water to the surrounding environment.

In the exemplary embodiment, the pump 110 may be a motor-driven submersible pump, such as the ST.E.P. Plus™ D Series 4" multi-stage submersible pump available from STA-RITE®. The pump 110 may have a maximum pump pressure (or head pressure) of about 75 PSI to avoid exceeding typical house water pressures of about 75 PSI. Other types of pumps with other pump pressures may also be used.

In the exemplary embodiment, the cycle tank 112 may include known cycle tanks having a relatively small capacity of less than about 3 gallons and more particularly about 2.1 gallons. The cycle tank 112 may be pressurized, for example, using an air bladder precharged with air at about 40 PSI.

The pump control device 120 generally includes a pressure opening device 122, such as a check valve, a venturi 124 in parallel with the check valve 122, and a pressure switch 126 coupled to the venturi 124. The liquid pumped by the pump 110 from the source 102 passes through the pressure opening device 122 and/or the venturi 124 to the destination system 104 and/or cycle tank 112. The pressure opening device 122 may be any device that opens to allow fluid to flow through at a predetermined pressure. One example of the pressure opening device 122 includes one or more spring-loaded check valves with a desired opening pressure creating a differential pressure (i.e., between the inlet pressure $P_i$ and outlet pressure $P_o$) in the pumped flow stream. In a residential water supply system, for example, a pressure opening device 122 may include one or more check valves that provide an opening pressure of about 5 PSI to create a 5 PSI differential pressure. One such check valve that may be used is the NEOPERL® OV20-120 spring-loaded check valve insert available from NEOPERL Inc.

Figure 1A:
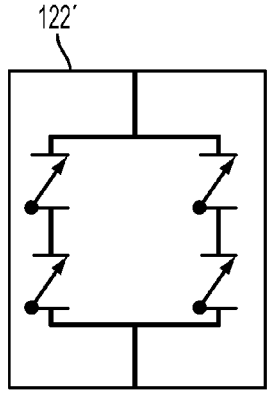
FIG. 1A is a schematic view of an embodiment of a pressure opening device that may be used in the pressure-controlled liquid supply system.

In one embodiment, two OV20-120 check valves may be used in series to create an approximate 5 PSI pressure differential. Using multiple check valves with lower opening pressures in series to create the desired pressure differential may reduce or eliminate noises that may be generated by a single valve with a higher opening pressure. In another embodiment, shown in FIG. 1A, a pressure opening device 122' may include parallel flow paths with check valves in series in each of the flow paths to achieve the desired pressure differential and the desired flow rate with reduced or eliminated noise. The pressure opening device 122, 122' is generally sized for the desired flow-rate and other types of check valves or pressure opening devices with other sizes and opening pressures may be used depending upon the application.

The venturi 124 is fluidly coupled across the differential pressure to allow a flow of liquid around the pressure opening device 122 through the venturi 124. When liquid is flowing through the venturi 124, the venturi 124 generally creates a reduced pressure zone at or proximate a throat region of the venturi 124 where a throat pressure ($P_t$) is lower than an outlet pressure ($P_o$) of the pump control device 120. As used herein, the "throat pressure" refers to a pressure in the throat region or proximate the throat region of the venturi. In a residential water supply system, for example, the venturi 124 may provide a flow of about ½ GPM where the inlet pressure ($P_t$) is 5 PSI greater than the outlet pressure ($P_o$), thereby creating a reduced pressure zone with a reduced throat pressure ($P_t$) in the throat region that is 5 PSI lower than the outlet pressure. One such venturi 124 that may be used is the venturi injector available as part number V3010-11 from Clack Corporation.

The pressure switch 126 is coupled to the venturi 124 proximate the throat region of the venturi 124 such that the switch pressure is obtained at the reduced pressure zone proximate the throat region, which is less than the outlet pressure when a flow exists through the venturi 124. The shut off pressure (i.e., the first pressure level) of the pressure switch 126 may be set less (e.g., 5 PSI less) than the maximum head pressure of the pump 110. If the pump 110 has a maximum pressure of 75 PSI, for example, the shut off pressure of the pressure switch 126 may be set to 70 PSI. In this example, the turn on pressure (i.e., the second pressure level) may be 50

PSI. One example of a pressure switch 126 is known as the Class 9013 Type FSG2J33 available from Square D.

During operation of a water supply system, for example, water flows through the pump control device 120 (i.e., through the pressure opening device 122 and the venturi 124) and into the destination system 104. When water flows through the venturi 124 above a certain flow rate (e.g., greater than ½ GPM), the switch pressure at the pressure switch 126 is less than the pressure switch shut-off pressure (e.g., 70 PSI), thereby keeping the pump 120 running at constant pressure at essentially any given flow. The venturi 124 thus acts similar to a flow switch in an electronic pump control by preventing the pump from switching off when a flow exists.

When water use is stopped, water flow into the destination system 104 stops but continues into the cycle tank 112. As the cycle tank 112 fills, the water outlet pressure ($P_o$) rises and eventually the water flow through the pressure opening device 122 stops as the pump 110 gets close to its maximum head pressure and is unable to generate sufficient inlet pressure ($P_i$) to open the pressure opening device 122. Once the water stops flowing through the pressure opening device 122, the remaining pressure differential (e.g., 5 PSI) across the venturi 124 forces all of the flow (e.g., ½ GPM) through the venturi 124, thereby continuing to fill the cycle tank 112. As the cycle tank 112 fills, the differential pressure and flow across the venturi 124 drops, thereby filling the tank 112 more slowly. The cycle tank 112 is thus filled slowly until the pressure differential across the venturi 124 stops creating the reduced pressure zone at the throat region of the venturi 124, resulting in an increased switch pressure taken at the venturi 124 and the pressure switch 126 shutting off the pump 110. The venturi 124 thus also provides a time delay similar to the delay used in electronic pump controls.

Figure 5:
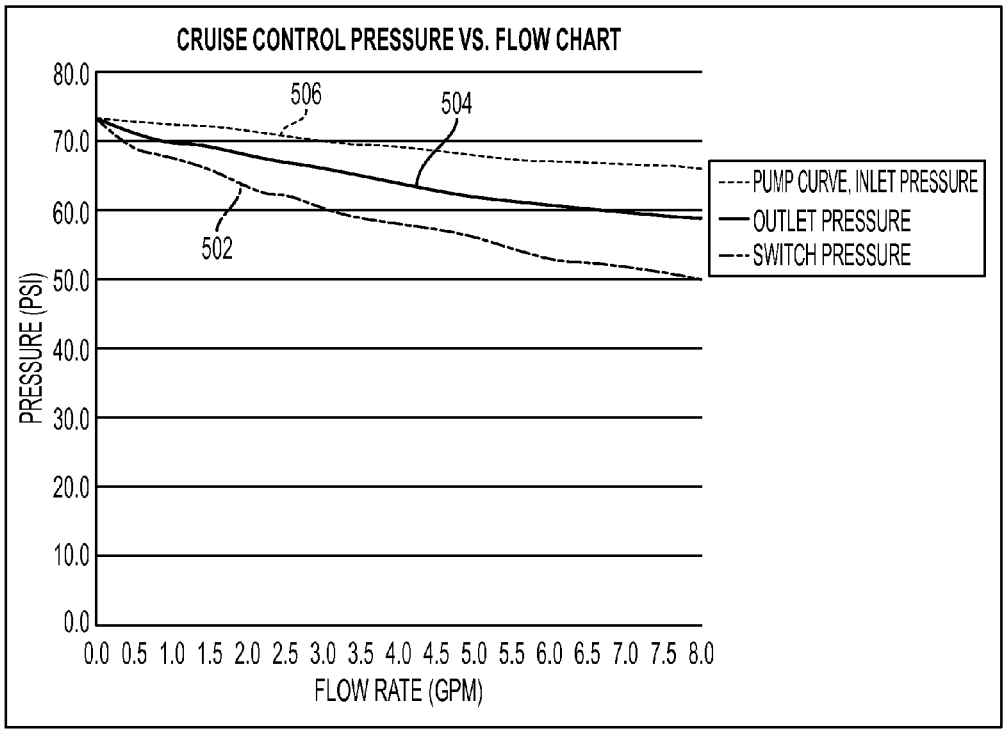
FIGS. 5 and 5A are graphs illustrating pressure versus flow rate at different locations in pump control devices, consistent with embodiments of the present invention.
Figure 5A:
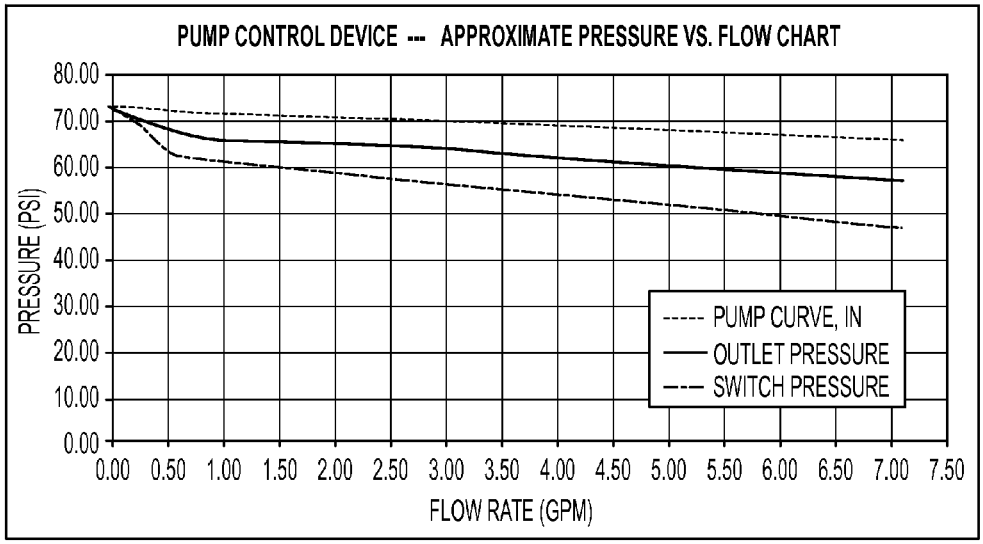

FIG. 5 shows the approximate pressure versus flow for one embodiment of a pump control device. As illustrated in FIG. 5, the switch pressure represented by curve 502 remains lower than the outlet pressure represented by curve 504, which is lower than the pump or inlet pressure represented by curve 506. If the shut-off pressure of the switch is 70 PSI, for example, using the reduced pressure zone at the throat region of the venturi to provide the switch pressure allows the pump to deliver greater than 70 PSI to the destination system at flow rates as low as ½ GPM or lower without switching the pump off. FIG. 5A shows the approximate pressure versus flow for a pump control device including 2 OV20-120 spring loaded check valves in series combined with 1 V3010-1L venturi in parallel.

Figure 2:
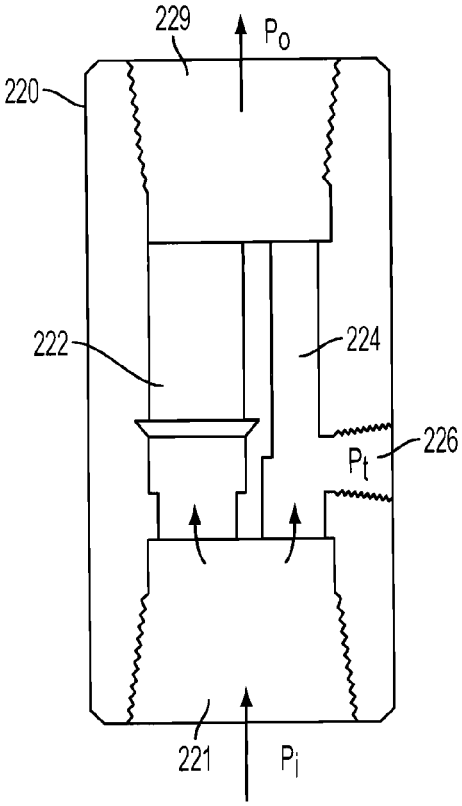
FIG. 2 is a side, partially cross-sectional view of a pump control device fitting, consistent with embodiments of the present invention.
Figure 3:
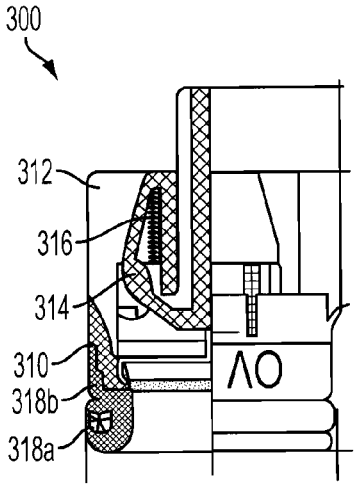
FIG. 3 is a partially cross-sectional view of a check valve that may be used as a pressure opening device in the pump control device fitting shown in FIG. 2.
Figure 4:
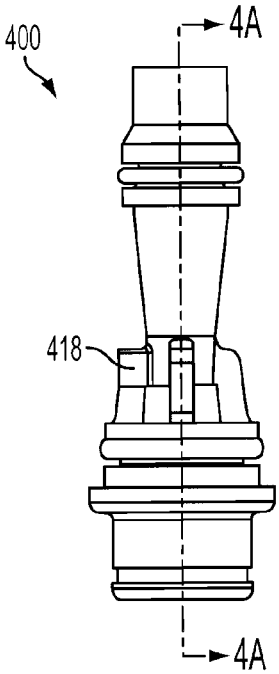
FIG. 4 is a side view of a venturi that may be used in the pump control device fitting shown in FIG. 2.
Figure 4A:
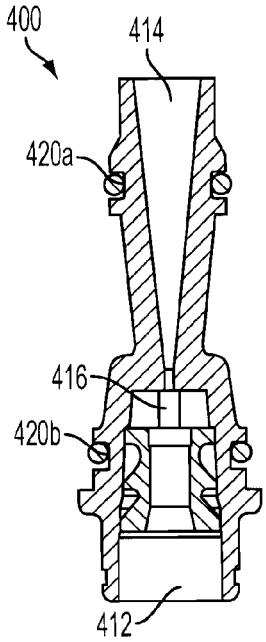
FIG. 4A is a partially cross-sectional view of the venturi with O-ring seals taken along line A-A in FIG. 4.

Referring to FIGS. 2-4, one embodiment of a pump control device is described and shown in greater detail. The pump control device may include a pump control device fitting 220 including a pressure opening device passageway 222 and a venturi passageway 224 containing the pressure opening device (e.g., a check valve) and venturi (not shown in FIG. 2). The control device fitting 220 may include an inlet port 221 and an outlet port 229 to provide an inlet to and an outlet from the pressure opening device and venturi located in the passageways 222, 224, respectively. The control device fitting 220 may also include a pressure monitor port 226 that provides access to the reduced pressure zone created at the throat region of the venturi. The inlet port 221 and outlet port 229 may be threaded to threadably engage a pipe or other such conduit. The pressure monitor port 226 may also be threaded to threadably engage a pressure switch (not shown in FIG. 2).

FIG. 3 shows in greater detail one embodiment of a check valve 300 that may be used as the pressure opening device in the pump control device. The check valve 300 includes a cap 310, a guide 312, a plunger 314, a spring 316 and seals 318*a*, 318*b*. The check valve 300 may thus be located and sealed within the pressure opening device passageway 222 shown in FIG. 2 such that the plunger 314 is movable within the guide 312 against the force of the spring 316 when sufficient opening pressure is applied, thereby allowing the liquid to flow through the check valve 300. Other types of check valves or pressure opening devices may also be used.

FIG. 4 shows one embodiment of a venturi 400 in greater detail. The venturi 400 includes a body portion 410 defining an inlet 412, an outlet 414, a throat region 416, a side port 418, and seals 420*a*, 420*b*. The venturi may thus be located and sealed within the venturi passageway 224 shown in FIG. 2 such that the liquid passes into the inlet 412, through the throat region 416 and out of the outlet 414. The side port 418 provides access to the reduced pressure zone created at the throat region 416 to obtain the switch pressure. Other types of venturi devices may also be used.

In summary, the pump control device is capable of switching a pump on and off but minimizes short cycling of the pump by preventing shut off of the pump while a flow is present through the pump control device and also avoids significant pressure drops in the output pressure by creating a reduced pressure zone to provide the switch pressure.

Consistent with one embodiment, a pump control device includes a pressure opening device configured to allow pumped liquid to pass through when an inlet pressure of the pumped liquid exceeds an opening pressure, thereby creating a pressure differential. The pump control device also includes a venturi in parallel with the pressure opening device to allow a flow of liquid around the pressure opening device and through the venturi. A pressure differential across the venturi creates a flow through the venturi and a reduced pressure zone at or proximate a throat region of the venturi. The reduced pressure zone has a lower pressure than an outlet pressure at an outlet of the pump control device when a flow is present through the venturi. The pump control device further includes a pressure switch fluidly coupled to the venturi at or proximate the throat region and responsive to a throat pressure. The pressure switch being configured to switch a pump off when the throat pressure exceeds a shut off pressure and to switch the pump on when the throat pressure falls below a turn on pressure. The shut off pressure is greater than the turn on pressure.

Consistent with another embodiment, a pressure-controlled liquid supply system includes a pump configured to pump a liquid from a liquid source to a destination system, a cycle tank coupled to the pump and configured to hold liquid temporarily before the destination system, and the pump control device coupled between the pump and the cycle tank such that the liquid passes through the pump control device.

Consistent with a further embodiment, a water treatment system includes a water treatment tank, a pump configured to pump water from the water treatment tank to a destination system, a cycle tank coupled to the pump and configured to hold water temporarily before the destination system, and the pump control device coupled between the pump and the cycle tank such that the water passes through the pump control device.

Consistent with yet another embodiment, an apparatus includes a control device fitting configured to be coupled between a pump and a destination system. The control device fitting includes an inlet port, an outlet port, a pressure opening device passageway, a venturi passageway, and a pressure monitor port providing access to the venturi passageway. The apparatus also includes a pressure opening device located in the pressure opening device passageway and configured to allow pumped liquid to pass through when an inlet pressure of the pumped liquid exceeds an opening pressure, thereby creating a pressure differential. The apparatus further includes a venturi located in the venturi passageway, in parallel with the pressure opening device, to allow a flow of liquid around the pressure opening device and through the venturi. A pressure differential across the venturi creates a flow through the venturi and a reduced pressure zone at or proximate a throat region of the venturi. The reduced pressure zone has a lower pressure than an outlet pressure at an outlet of the pump control device when a flow is present through the venturi. The pressure monitor port provides access to the reduced pressure zone created at the throat region of the venturi.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A pressure-controlled liquid supply system comprising:

a pump configured to pump a liquid from a liquid source to a destination system;

a cycle tank coupled to the pump and configured to hold liquid temporarily before being supplied to the destination system;

a pump control device coupled between the pump and the cycle tank such that the liquid passes through the pump control device, the pump control device comprising:

a pressure opening device configured to allow pumped liquid to pass through when an inlet pressure of the pumped liquid exceeds an opening pressure of the pressure opening device, thereby creating a pressure differential;

a venturi in parallel with the pressure opening device to allow a flow of liquid around the pressure opening device and through the venturi, wherein a pressure differential across the venturi creates a flow through the venturi and a reduced pressure zone at or proximate a throat region of the venturi, the reduced pressure zone having a lower pressure than an outlet pressure at an outlet of the pump control device when a flow is present through the venturi; and a pressure switch fluidly coupled to the venturi at or proximate the throat region and responsive to a throat pressure, the pressure switch being configured to switch the pump off when the throat pressure exceeds a shut off pressure and to switch the pump on when the throat pressure falls below a turn on pressure, the shut off pressure being greater than the turn on pressure.

2. The pressure-controlled liquid supply system of claim 1 further including a liquid storage tank, wherein the pump is located in the storage tank.

3. The pressure-controlled liquid supply system of claim 1 wherein the pressure opening device includes at least one spring-loaded check valve.

4. The pressure-controlled liquid supply system of claim 1 wherein the pressure opening device includes at least two spring-loaded check valves in series.

5. The pressure-controlled liquid supply system of claim 1 wherein the pressure opening device includes parallel flow paths and at least two spring-loaded check valves in series in each of the parallel flow paths.

6. The pressure-controlled liquid supply system of claim 1 wherein the shut off pressure is less than a head pressure of the pump.

7. The pressure-controlled liquid supply system of claim 1 wherein the pump control device includes a control device fitting configured to be coupled between the pump and the destination system, wherein the control device fitting includes the pressure opening device and the venturi located therein.

8. The pressure-controlled liquid supply system of claim 7 wherein the control device fitting includes an inlet port providing an inlet to the pressure opening device and the venturi, an outlet port providing an outlet from the pressure opening device and the venturi, and a pressure monitor port providing access to the reduced pressure zone created at the throat region of the venturi.

9. The pressure-controlled liquid supply system of claim 1 wherein the pressure differential is about 5 PSI.

10. The pressure-controlled liquid supply system of claim 1 wherein the pump is configured to pump water.

11. A pump control device comprising:

a pressure opening device configured to allow pumped liquid to pass through when an inlet pressure of the pumped liquid exceeds an opening pressure, thereby creating a pressure differential;

a venturi in parallel with the pressure opening device to allow a flow of liquid around the pressure opening device and through the venturi, wherein a pressure differential across the venturi creates a flow through the venturi and a reduced pressure zone at or proximate a throat region of the venturi, the reduced pressure zone having a lower pressure than an outlet pressure at an outlet of the pump control device when a flow is present through the venturi; and a pressure switch fluidly coupled to the venturi at or proximate the throat region and responsive to a throat pressure, the pressure switch being configured to switch a pump off when the throat pressure exceeds a shut off pressure and to switch the pump on when the throat pressure falls below a turn on pressure, the shut off pressure being greater than the turn on pressure.

12. The pump control device of claim 11 further comprising a control device fitting configured to be coupled between the pump and a destination system, wherein the control device fitting includes the pressure opening device and the venturi located therein.

13. The pump control of claim 12 wherein the control device fitting includes an inlet port providing an inlet to the pressure opening device and the venturi, an outlet port providing an outlet from the pressure opening device and the venturi, and a pressure monitor port providing access to the reduced pressure zone created at the throat region of the venturi.

14. The pump control of claim 11 wherein the pressure opening device includes at least one spring-loaded check valve.

15. The pump control of claim 11 wherein the pressure opening device includes at least two spring-loaded check valves in series.

16. The pump control of claim 11 wherein the pressure opening device includes parallel flow paths and at least two spring-loaded check valves in series in each of the parallel flow paths.

17. A water treatment system comprising:

a water treatment tank;

a pump configured to pump water from the water treatment tank to a destination system;

a cycle tank coupled to the pump and configured to hold water temporarily before being supplied to the destination system; and a pump control device coupled between the pump and the cycle tank such that the water passes through the pump control device, the pump control device comprising:

a pressure opening device configured to allow pumped liquid to pass through when an inlet pressure of the pumped liquid exceeds an opening pressure, thereby creating a pressure differential;

a venturi in parallel with the pressure opening device to allow a flow of liquid around the pressure opening device and through the venturi, wherein a pressure differential across the venturi creates a flow through the venturi and a reduced pressure zone at or proximate a throat region of the venturi, the reduced pressure zone having a lower pressure than an outlet pressure at an outlet of the pump control device when a flow is present through the venturi; and a pressure switch fluidly coupled to the venturi at or proximate the throat region and responsive to a throat pressure, the pressure switch being configured to switch the pump off when the throat pressure exceeds a shut off pressure and to switch the pump on when the throat pressure falls below a turn on pressure, the shut off pressure being greater than the turn on pressure.

18. The water treatment system of claim 17 wherein the cycle tank has a capacity less than about 3 gallons.

19. The water treatment system of claim 17 wherein the shut-off pressure is about 70 PSI and the turn on pressure is about 50 PSI.

20. The water treatment system of claim 19 wherein the pump has a maximum head pressure of about 75 PSI.

21. The water treatment system of claim 20 wherein the pressure differential is about 5 PSI.

22. The water treatment system of claim 21 wherein the reduced pressure zone is about 5 PSI less than the outlet pressure at a flow rate of about 1/2 GPM.

23. An apparatus comprising:

a control device fitting configured to be coupled between a pump and a destination system, the control device fitting including an inlet port, an outlet port, a pressure opening device passageway, a venturi passageway, and a pressure monitor port providing access to the venturi passageway;

a pressure opening device located in the pressure opening device passageway and configured to allow pumped liquid to pass through when an inlet pressure of the pumped liquid exceeds an opening pressure, thereby creating a pressure differential; and a venturi located in the venturi passageway, in parallel with the pressure opening device, to allow a flow of liquid around the pressure opening device and through the venturi, wherein a pressure differential across the venturi creates a flow through the venturi and a reduced pressure zone at or proximate a throat region of the venturi, the reduced pressure zone having a lower pressure than an outlet pressure at an outlet of the pump control device when a flow is present through the venturi, and wherein the pressure monitor port provides access to the reduced pressure zone of the venturi.

24. The apparatus of claim 23 wherein the pressure opening device includes at least one spring-loaded check valve.

* * * * *